US006823767B2

(12) United States Patent
Vornfett et al.

(10) Patent No.: US 6,823,767 B2
(45) Date of Patent: Nov. 30, 2004

(54) METHOD FOR FUZE-TIMING AN AMMUNITION UNIT, AND FUZE-TIMABLE AMMUNITION UNIT

(75) Inventors: Karl-Ulrich Vornfett, Unterluss (DE); Jürgen Voss, Ebstorf (DE)

(73) Assignee: Rheinmetall Landsysteme GmbH, Kiel (DE)

( * ) Notice: Subject to any disclaimer, the term of this patent is extended or adjusted under 35 U.S.C. 154(b) by 0 days.

(21) Appl. No.: 10/278,989

(22) Filed: Oct. 24, 2002

(65) Prior Publication Data

US 2003/0136250 A1 Jul. 24, 2003

Related U.S. Application Data

(60) Provisional application No. 60/330,542, filed on Oct. 24, 2001.

(30) Foreign Application Priority Data

Oct. 25, 2001 (DE) ..... 10152862

(51) Int. Cl.[7] ..... F42C 17/04
(52) U.S. Cl. ..... 89/6.5
(58) Field of Search ..... 89/6, 6.5

(56) References Cited

U.S. PATENT DOCUMENTS

| | | | | |
|---|---|---|---|---|
| 4,577,561 A | | 3/1986 | Perry | |
| 4,633,779 A | | 1/1987 | Biggs et al. | |
| 4,799,429 A | | 1/1989 | LaBudde et al. | |
| 5,894,102 A | * | 4/1999 | Oberlin et al. | 89/6.5 |
| 5,942,714 A | * | 8/1999 | Oberlin et al. | 89/6.5 |
| 6,189,430 B1 | * | 2/2001 | Vornfett | 89/6.5 |

FOREIGN PATENT DOCUMENTS

| | | | |
|---|---|---|---|
| DE | 30 27 755 | | 2/1982 |
| DE | 33 01 251 C1 | * | 6/1984 |
| DE | 197 16 227 | | 10/2000 |
| EP | 0 283 386 A1 | * | 9/1988 |
| EP | 0 361 583 A1 | | 4/1990 |
| EP | 0 368 738 A1 | | 5/1990 |
| EP | 0 430 052 | | 6/1991 |
| EP | 0 965 815 A2 | | 12/1999 |
| FR | 2 574 922 A1 | | 6/1986 |

OTHER PUBLICATIONS

Gommlich, Hans: "Schnittstellen in Datenübertragungssystemen". (Interfaces In Data Transmission Systems), Special Edition from bits 45 and 46 Eningen et al., Wandel & Goltermann, 1989, pp. 1–19.

* cited by examiner

*Primary Examiner*—Stephen M. Johnson
(74) *Attorney, Agent, or Firm*—Venable LLP; Stuart I. Smith

(57) ABSTRACT

The invention is based on the concept of providing a digital data transmission of the fuze-timing data into a fuze-timable ammunition unit, for example with an HDB-3 (High-Density Bipolar) transmission code and voltage modulation. As is known from asynchronous data transmission, a start byte and a stop byte are respectively positioned in front of and behind the HDB-3 code, and are therefore components of thee fuze-timing data. The fuze-timing time is transmitted numerically as a data byte between the start and stop bytes.

Accordingly, the ammunition unit (3) includes fuze-timing electronics (4), which comprise a (voltage) demodulator (30), a (current) modulator (31) and a microprocessor (32) having an RC-oscillator cycle counter (32.1), an RC oscillator (33), a fuze-timing counter (34) and an actuator end stage (36). A firing sensor (35) serves as the fuze-timing-time triggering element at the start of the flight phase. Additionally, operating data of the oscillator (33) are corrected, so simple RC oscillators can be used.

20 Claims, 4 Drawing Sheets

METHOD FOR FUZE-TIMING AN AMMUNITION UNIT, AND FUZE-TIMABLE AMMUNITION UNIT

CROSS-REFERENCE TO RELATED APPLICATIONS

This application claims the benefit of U.S. provisional application Ser. No. 60/330,542, filed Oct. 24, 2001 now abandoned.

BACKGROUND OF THE INVENTION

The invention relates to a method for fuze-timing an ammunition unit and a fuze-timable ammunition unit.

For identifying the ammunition of an ammunition unit, ammunition-specific data, such as the type of ammunition, batch number, date of manufacture, etc., may be stored directly on a data memory (ammunition-data chip) located in the ammunition unit. These data are read out automatically when the ammunition unit is brought into a chamber of a weapons system. Often, a fire-control computer of the weapons system reads out the data. The computer then generates directional signals for the aiming system of the weapon, based on ammunition- and target-specific data, and control signals for activating an electrically programmable projectile fuze located in the respective cartridge or ammunition unit.

DE 40 08 253 C2 discloses an apparatus for fuze-timing a projectile fuze, which comprises a coil arrangement.

DE 197 16 227 C2 describes a weapons system having an ammunition unit that contains a microcontroller; this system has no fire-control computer as such. The computer is replaced by the system interaction within the ammunition- and device-controlled weapons system.

DE 198 27 378 A1 describes a weapons system having a fire-control system and a generic ammunition unit that can be fired from a weapon. For continuous monitoring of the electrical connection between the fire-control computer and the actuatable assemblies in the respective ammunition unit, a bi-directional data transmission takes place over the two lines required for the supply of voltage and current to the electronic circuits of the ammunition unit. The data transmission from the fire-control system to the electronic switching device in the ammunition unit is effected through the modulation of the voltage signals of the supply voltage. The feedback to the fire-control system is effected through the modulation of the current signals of the operating current. For this purpose, a converter is connected between the fire-control system and the electronic switching device. The fuze-timing data for setting the fuze are transmitted in analog fashion. The completed fuze timing is then acknowledged through a brief increase in the operating current. A drawback of this analog fuze timing is the required additional fuze-timing signals, which must be generated by separate hardware and software. Another disadvantage is that the hardware dictates the fuze-timing precision.

SUMMARY OF THE INVENTION

It is the object of the present invention to avoid the disadvantages known to be associated with analog fuze timing.

The object is accomplished by a method for fuze-timing an ammunition unit, including the steps of: digitizing the fuze-timing time through modulation; inserting a stop byte and a start byte in a system disposed upstream of the ammunition unit; and, transmitting the encoded fuze-timing data into the ammunition unit, demodulating the fuze-timing data in a demodulation stage and transmitting the data to a microprocessor for internal further processing, in an interaction with an oscillator.

The invention is based on the concept of providing a digital data transmission of the fuze-timing data into a fuze-timable ammunition unit, for example with an HDB-3. (High-Density Bipolar) transmission code, and voltage modulation. As is known from asynchronous data transmission, a start byte and a stop byte are respectively positioned in front of and behind the HDB-3 code, and are therefore components of the fuze-timing data. The fuze-timing time is transmitted numerically as a data byte between the start and stop bytes.

The start and stop bytes are distinguished from all other bit patterns in the weapons system in order to assure a unique identification of the start and stop signal. Preferably, the start byte begins, and the stop byte ends, with positive modulation pulses. This prevents a data transmission from being initiated or halted erroneously due to a temporary line disconnection or interruptions in the supply voltage.

For this purpose, the ammunition unit includes fuze-timing electronics, which comprise a (voltage) demodulator, a (current) modulator and a microprocessor having an RC-oscillator cycle counter, an RC oscillator, a fuze-timing counter and an actuator end stage. A firing sensor serves as the triggering element of the fuze-timing counter at the start of the flight phase. The fuze-timing data are digitized in an ammunition communications system that is integrated between the ammunition unit and a weapon that can fire the ammunition unit.

Further advantages ensue from the description claims.

The encoding of the binary data into bipolar data (HDB code) results in a DC-free voltage and current modulation, as well as a continuous synchronization of the data-transmission interface. In a modification of the invention, thief DC-free modulation also allows for the simultaneous transmission of the fuze-timing data and the voltage and current data on a connecting line provided for supplying the voltage to the fuze-timing electronics; the average values of the supply voltage and the output current of the ammunition communication system (ACS), for example, remain constant.

A time-synchronous recognition of the start and stop bytes can be effected by an interrupt-controlled evaluation of the signals from a voltage demodulator by the microprocessor and software in the fuze-timing electronics (generation of a countergate).

In a modification of the invention, the digital transmission of the fuze-timing data permits the properties of a clock oscillator (time base) that is required for fuze timing to be taken into consideration in the fuze-timing electronics. Frequency instability and aging phenomena may be temporarily compensated through the determination of the oscillator clock rate and the calculation of a time-corrected desired fuze-timing value, so a current-saving, firing-proof RC oscillator can be used. The time base in the fuze-timing electronics is calibrated with the aid of the data-transmission speed (baud rate); the transmission from a quartz oscillator in the ACS to the RC oscillator in the fuze-timing electronics is effected with quartz precision.

The feedback via the current, corrected programmed fuze-timing data is provided with the aid of a digital supply-current modulation of the fuze-timing data that have been programmed in.

The data transmission is bi-directional.

The feedback of the programmed, time-corrected desired fuze-timing value and the number of the RC oscillator clock rate can also be used for a system check. This allows the ACS to determine whether the fuze timing and time corrections have been executed properly.

A further check of the data transmission involves checking the number of transmitted bits, and performing a check sum.

The advantage of digital fuze timing is that the fuze-timing precision can be varied with software, because it is not subjected to hardware-related constraints. The fuze-timing precision can be set, for example, through the selection of the data transmission time.

Of course, the use of a definable ammunition data chip (ADC) inside the ammunition unit further ensures that the same data and voltage transfer can be used for the ADC as for the fuze timing. In other words, the structural and software costs remain low. The advantage of a definable ADC is that, for example, aging phenomena in the ammunition can be compensated with experimental values. In a special embodiment, electrical assemblies of the fuze-timing electronics can form the ADC.

The result is highly flexible fuze-timing electronics that additionally offer greater protection of the electronic assemblies through the use of only positive or only negative (unipolar) voltages.

The invention is described in detail below by way of an exemplary embodiment shown in the drawings.

DESCRIPTION OF THE PREFERRED EMBODIMENT

Figure 1:
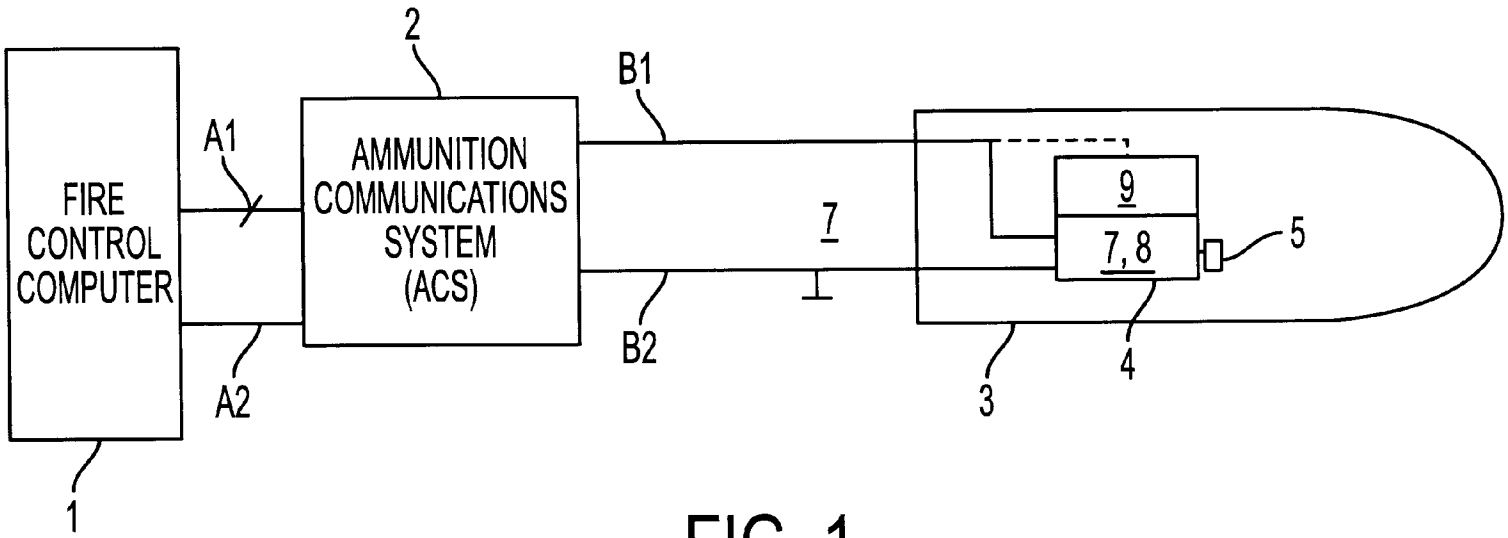
FIG. 1 is a schematic representation of a weapons system having a unit that supplies data, an ammunition-communications system, and an ammunition unit equipped with electronic assemblies.

FIG. 1 is a schematic representation of the general design of a weapons system having a unit 1 that supplies data, an ammunition-communications system (ACS) 2 and an ammunition unit 3. The ammunition unit 3 comprises fuze-timing electronics 4 that are electrically connected to a fuze 5 of the ammunition unit 3. The unit 1 that supplies the data is preferably a fire-control computer.

A data line A1, a CAN bus, and a further line A2 for a voltage and current supply $U_S$, $I_S$ connect the fire-control computer 1 electrically to the ACS 2. Lines B1 and B2 produce the electrical connection between the ACS 2 and the ammunition unit 3; the line B2 represents a ground line, while the line B1 is responsible for supplying voltage and transmitting data to the ammunition unit 3. The fuze-timing electronics 4 comprise electrical assemblies 7 for the programming phase, and electrical assemblies 8 for the flight phase.

Figure 2:
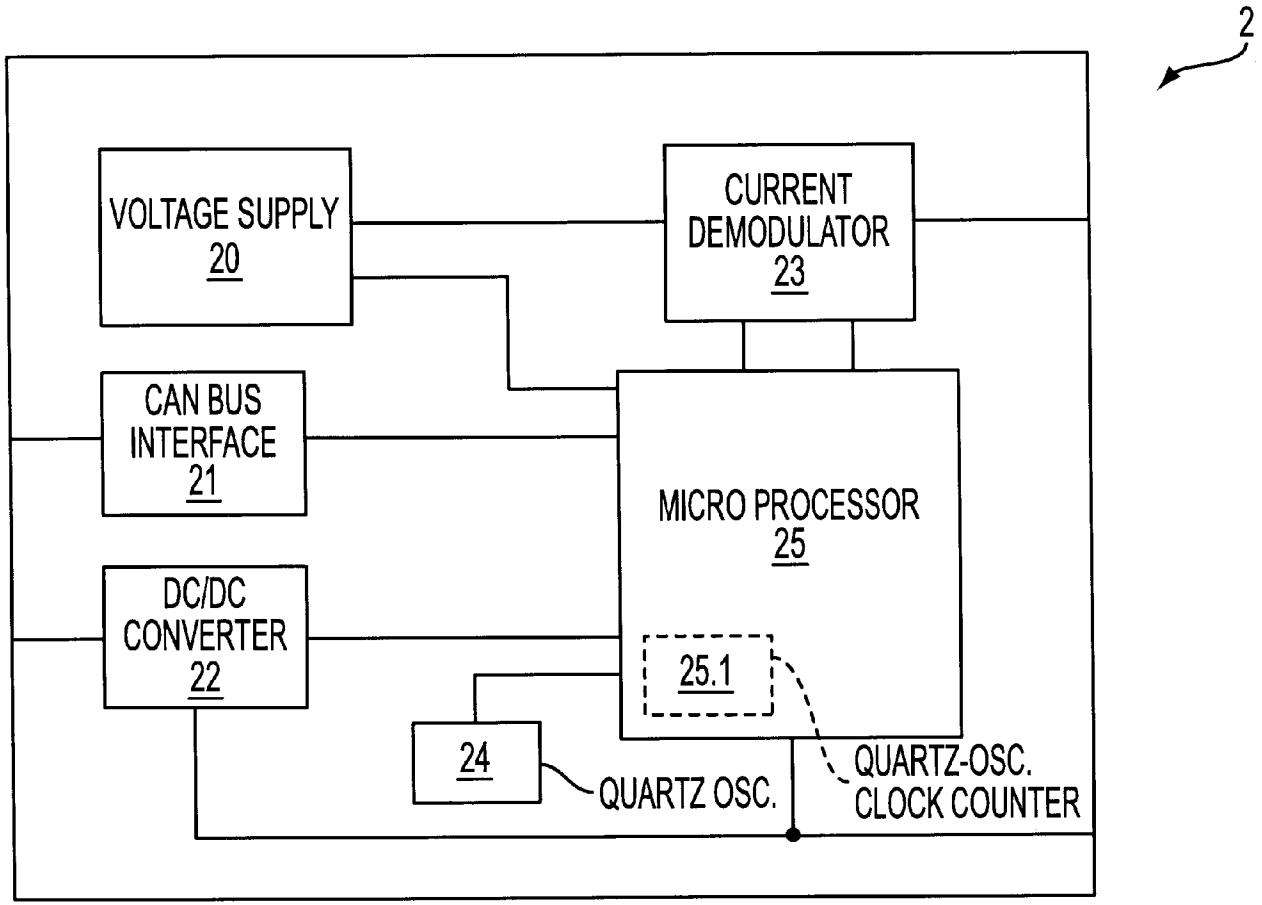
FIG. 2 is a block diagram of the essential electronic assemblies of the ammunition-communications system from FIG. 1.

FIG. 2 shows a general design of the ACS 2.

In addition to assemblies that are not shown for the sake of a good overview, the ACS 2 comprises a voltage supply with a voltage modulator 20, a CAN bus interface 21 and a DC/DC converter 22. The outputs and inputs of these assemblies 20–22 and those of a quartz oscillator 24 are connected to a microprocessor 25 having a quartz-oscillator clock counter 25.1. The voltage supply 20 is further connected on the output side to a current demodulator 23, which accesses the microprocessor 25 with two connections. A further, preferably bi-directional, line of the current demodulator 23 leads, in an extension as the line B1, to the ammunition unit 3. The DC/DC converter and the microprocessor 25 each connect to a necessary ground via a connection that connects the ammunition unit 3 to ground via the line B2.

Figure 3:
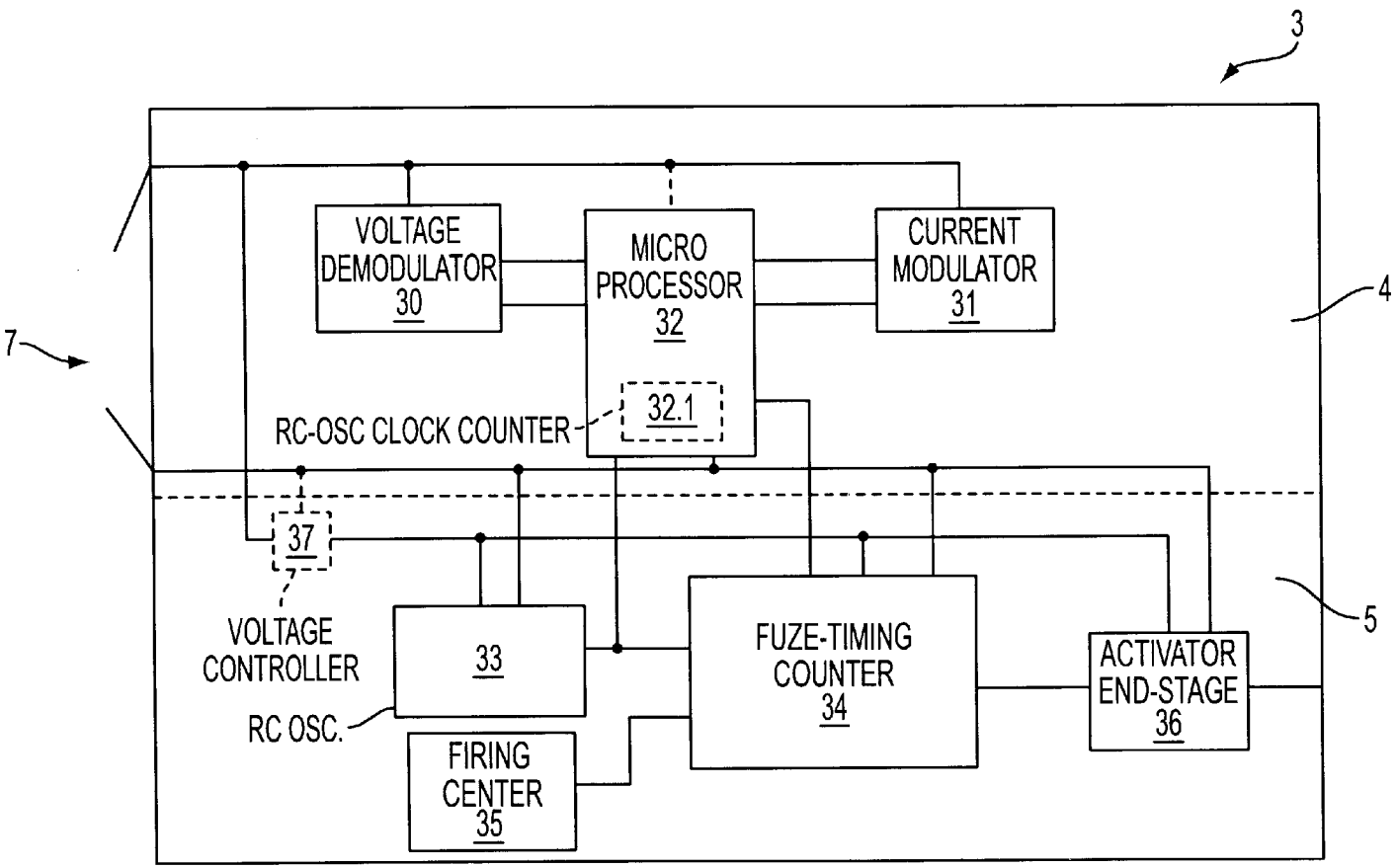
FIG. 3 is a block diagram of the essential electrical assemblies of the fuze-timing electronics of the ammunition unit from FIG. 1.

FIG. 3 illustrates the fuze-timing electronics 4 in greater detail; here, only the essential assemblies are noted. These are a voltage demodulator 30, a current modulator 31 and a microprocessor 32 having an RC-oscillator clock counter 32.1. These assemblies 30–32, which are grouped under the reference character 7 in FIG. 1, are necessary for programming in the programming phase. An RC oscillator 33, a fuze-timing counter 34 and an actuator end stage 36, which are grouped under the reference character 8 in FIG. 1, are responsible for the flight phase. With the future availability of microprocessors with lowest power consumption, the function of the electrical assemblies with reference character 7 and 8 in FIG. 1 can be completed ingenious by a single microprocessor. Also shown is a firing sensor 35, which triggers the programmed fuze-timing time at the start of the flight phase. A voltage controller 37 is shown to indicate functionality, but is not described in detail.

Figure 4:
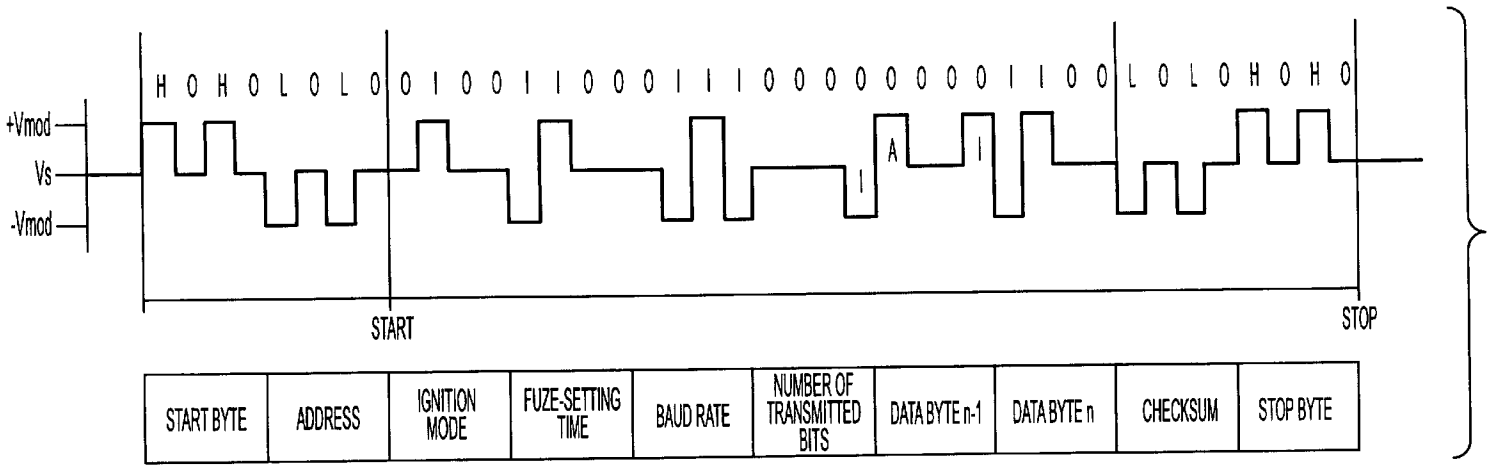
FIG. 4 is a representation of the data transmission from the ammunition-communications system to the fuze, with an associated data protocol.

Fuze timing is effected as follows:

The ammunition-specific data are automatically read out from an ammunition-data chip 9 into the fire-control computer 1. The computer determines the necessary fuze-timing time for the fuze 5. This information is forwarded to the ACS 2, in which the microprocessor 25 and the voltage-modulation assembly 20 encode the data (HBD-3 code); a start byte and a stop byte that differ from the data word of the code are attached to the beginning and end, respectively, of the encoded fuze-timing time. The encoded signal is transmitted at a baud rate that is derived from the frequency (clock) of the quartz oscillator 24 of the ACS 2 (FIG. 4), counted in the quartz-oscillator clock counter 25.1, then transmitted, in a precise temporal relationship, to the fuze-timing electronics 4 and read into the microprocessor 32. Here, the RC-oscillator clock counter 32.1 measures the cycles of the RC oscillator 33 between the start and stop bytes. In principle, this would end the programming of the fuze-timing data.

A problem that may arise in digital fuze timing when a current-saving, firing-proof RC oscillator is used as the clock oscillator 33 in the ammunition device 3 is that the precision of the programmed fuze-timing time is inadequate due to the poor quality of this type of oscillator.

In contrast, the invention sufficiently compromises the negative characteristics of the RC oscillator 32 for the duration of the flight phase. For this purpose, a transmission time $T_{\ddot{U}}B$is calculated with the microprocessor 32 of the fuze-timing electronics 4. This time results from the transmitted data bytes "number of transmitted bits" and "baud rate," which are written into the microprocessor 32 during programming and are shown in the data protocol according to FIG. 4.

$T_{\ddot{U}}B$=number of transmitted bits/baud rate

The specified baud rate is realized by the quartz-precise microprocessor control in the ACS 2.

A time-corrected desired fuze-timing value $T_{SOLL}$ is determined from the transmission time $T_{\ddot{U}}B$and the RC-oscillator clock rate $RC_{T1-n}$ determined in this time.

This is calculated from $T_{SOLL}=RC_{T1-n}/T_{\ddot{U}}B\times$fuze-timing time.

The programming of the fuze-timing counter 34 with the time-corrected $T_{SOLL}$ results in virtual quartz precision, because the clock frequency of the RC oscillator 32 does not change notably during the short flight phase. When the ammunition is fired, the firing sensor 35 enables the fuze-timing counter 34. The counter then counts, for example, backward to zero with the RC-oscillator clock from the desired fuze-timing value $T_{SOLL}$ of the fuze-timing counter outputted by the RC-oscillator clock counter 32.1, and initiates the fuze 5 when reaching it via the actuator end stage 36.

The precision of the fuze timing can also be set through a purposeful selection of the data-transmission time $T_{\ddot{U}}B$.

Figure 5:
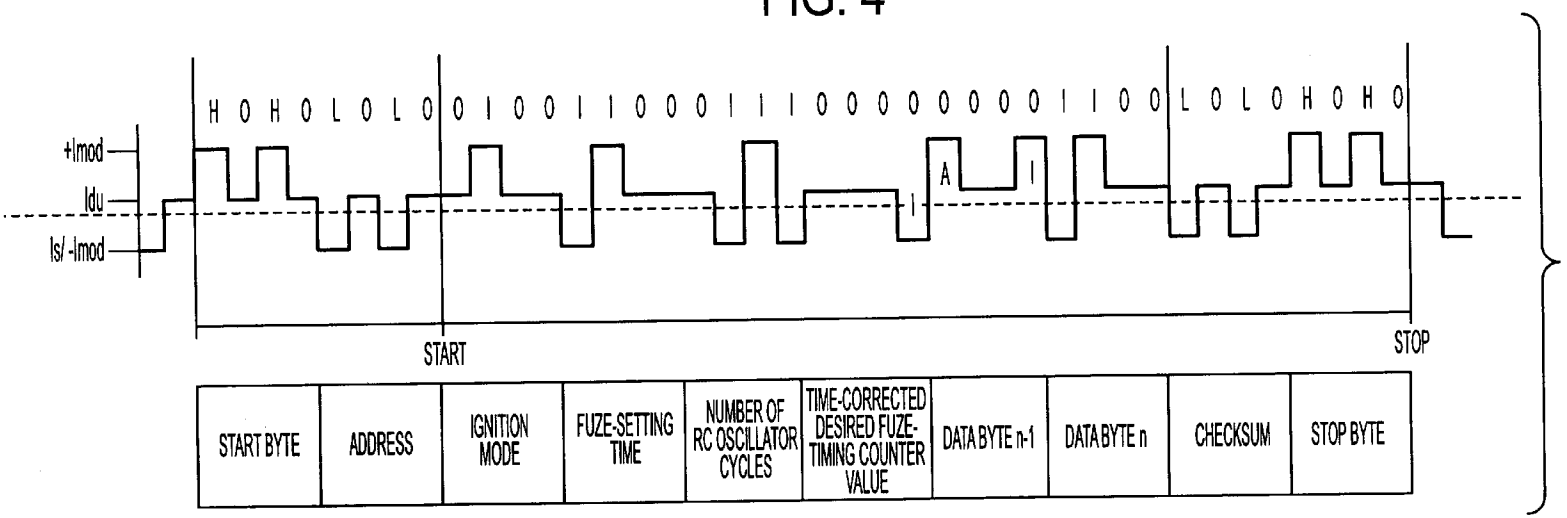
FIG. 5 is a representation of the data transmission from the fuze, with an associated data protocol.

These corrective measures implemented in the ammunition unit 3 prior to firing are reported back to the ACS 2 by way of a current modulation in the current modulator 31 and the line B1, as shown in FIG. 5, and are prepared in the current demodulator 23 for the microprocessor 25. Also in this case, a start byte and a stop byte are written in front of or behind the encoded data word in the encoding of the feedback. The microprocessor 25 can use this information, for example, in system control. Moreover, it is possible to check the accuracy of the fuze timing and the time correction.

Of course, the invention can be used in numerous other advantageous applications. For example, when a definable ammunition-data chip (ADC) 9 is integrated into the ammunition unit 3 (FIG. 1), the same data and voltage transfer can take place over the common line B1. The hardware outlay for the ACS 2 remains unchanged. The software can be easily adapted.

The invention now being fully described, it will be apparent to one of ordinary skill in the art that many changes and modifications can be made thereto without departing from the spirit or scope of the invention as set forth herein.

What is claimed is:

1. A method for fuze-timing an ammunition unit, including the following steps:

digitizing the fuze-timing time through modulation;

inserting a stop byte and a start byte in a system disposed upstream of the ammunition unit to provide encoded fuze-timing data; and transmitting the encoded fuze-timing data into the ammunition unit, and demodulating the encoded fuze-timing data in a demodulation stage and transmitting them to a microprocessor for internal further processing, in an interaction with an oscillator.

2. The method according to claim 1, wherein the digitized encoded fuze-timing data are transmitted through voltage modulation.

3. The method according to claim 1, wherein the transmission code is a bipolar, DC-free code.

4. The method according to claim 3, wherein the bipolar, D.C.-free code is a HBD-3 code.

5. The method according to claim 1, wherein a fuze-timing time between the start and stop bytes is transmitted numerically as a data byte.

6. The method according to claim 1, wherein the start byte begins with a positive modulation pulse, and the stop byte ends with a positive modulation pulse, and the start and stop bytes do not correspond to the transmission code.

7. The method according to claim 1, wherein a transmission of the fuze-timing data occurs simultaneously with transmission of voltage and current data.

8. The method according to claim 1, wherein the clock oscillator required for fuze timing is corrected with a time-corrected desired fuze-timing value.

9. The method according to claim 8, wherein the time-corrected desired fuze-timing value is calculated through the determination of the oscillator clock rate and a transmission time.

10. The method according to claim 9, wherein the transmission time is determined from a ratio of the number of transmitted bits to the baud rate.

11. The method according to claim 1, wherein, in the use of a definable ammunition-data chip inside the ammunition unit, the same data and voltage transfer can be used for the ammunition-data chip as for the fuze timing.

12. The method according to claim 1, wherein a report is made on fuze-timing data transmitted to the microprocessor, and is digitized through a digital supply-current modulation.

13. A fuze-timable ammunition unit, having fuze-timing electronics with an oscillator, which electronics can be connected on an input side to an external voltage and current supply device, and on an output side to a fuze, and wherein:

a demodulator and a microprocessor are integrated into the fuze-timing electronics, with the demodulator receiving and demodulating fuze-timing-data received prior to firing of the ammunition unit and supplying the demodulated data to the microprocessor;

the microprocessor is provided with an oscillator-clock counter connected to count the output of the oscillator;

the oscillator is disposed upstream of a fuze-timing counter that, prior to firing of the ammunition unit, is programmed by the microprocessor with a corrected fuze-timing time based on the demodulated data and the count of the oscillator-clock counter;

an actuator end stage responsive to an output trigger signal from the time-fuzing counter for actuating a fuze; and, a firing sensor that is disposed on the ammunition unit and that senses; firing of the ammunition unit and triggers the fuze-timing counter to begin counting output signals of the oscillator, and provide a trigger signal to the actuator end stage upon reaching the programmed fuze-timing time.

14. The ammunition unit according to claim 13, wherein the oscillator is an RC oscillator.

15. The ammunition unit according to claim 13, wherein the ammunition unit is connected to an upstream system during the transmission of the fuze-timing data, with the upstream system additionally functioning as a voltage- and current-supply device.

16. The ammunition unit according to claim 15, wherein the transmission takes place in two directions between the upstream system and the ammunition unit by way of at least one line.

17. The ammunition unit according to claim 15, wherein the upstream system is an ammunition-communications system that is connected between a weapons system and the ammunition unit.

18. The ammunition unit according to claim 17, wherein the upstream system includes a voltage supply with voltage modulation, a CAN bus interface and a DC/DC converter each having an output which together, with outputs of a quartz oscillator, lead to inputs of a further microprocessor that has a quartz-oscillator clock counter, and with the voltage supply being connected on an output side to a current demodulator, which accesses the further microprocessor with two connections.

19. A weapon system comprising: a control unit for providing fuze-timing data; an ammunition unit according to claim 13; and an ammunition communication system disposed between the control unit and the ammunition unit for transmitting data between the control and ammunition units.

20. A weapon system according to claim 19 further comprising an ammunition data chip disposed in the ammunition unit and containing at least ammunition specific data that can be read out and transmitted to the control unit.

* * * * *